United States Patent [19]

Drahos

[11] Patent Number: 5,043,105

[45] Date of Patent: Aug. 27, 1991

[54] FUEL ATOMIZING DEVICE FOR CARBURETORS

[75] Inventor: Lloyd J. Drahos, Rochester, Minn.

[73] Assignee: Unique Innovations, Inc., Rochester, Minn.

[21] Appl. No.: 495,404

[22] Filed: Mar. 19, 1990

[51] Int. Cl.[5] ..... F02M 19/08

[52] U.S. Cl. ..... 261/78.1; 261/DIG. 39

[58] Field of Search ..... 261/78.1, DIG. 39

[56] References Cited

U.S. PATENT DOCUMENTS

| | | | |
|---|---|---|---|
| 2,560,220 | 8/1946 | Graziano | 219/38 |
| 2,714,503 | 8/1955 | Heisler | 261/78 |
| 2,899,185 | 8/1959 | Rector | 261/72 |
| 3,012,400 | 12/1961 | Corson, Jr. | 261/78.1 |
| 3,437,467 | 8/1969 | Jacobus | 48/180 |
| 3,467,072 | 9/1969 | Toesca | 123/141 |
| 3,873,650 | 3/1975 | Lamkin | 261/78.1 |
| 3,955,545 | 5/1976 | Priegel | 123/199 |
| 4,094,934 | 6/1978 | Tuckey et al. | 261/64 |
| 4,133,849 | 1/1979 | Hecht | 261/78 |
| 4,139,582 | 2/1979 | Collins | 261/78.1 |
| 4,259,021 | 3/1981 | Goudy, Jr. | 366/118 |

FOREIGN PATENT DOCUMENTS

| | | | |
|---|---|---|---|
| 503520 | 6/1920 | France | 261/78.1 |
| 1008178 | 5/1952 | France | 261/78.1 |
| 56-151249 | 11/1981 | Japan | 261/78.1 |
| 0228322 | 10/1985 | U.S.S.R. | 261/78.1 |
| 81/02611 | 9/1981 | World Int. Prop. O. | 261/78.1 |

*Primary Examiner*—Tim Miles

*Attorney, Agent, or Firm*—Palmatier & Sjoquist

[57] ABSTRACT

A fuel atomizing device for carburetors having a main discharge nozzle located within at least one venturi. The device comprises a hollow body extending downwardly and outwardly with a bottom opening adapted to slide over the main discharge nozzle in a sleeve-like arrangement. A fuel atomizing disc is supported concentrically by the body having top and bottom surfaces and an outer diameter atomizing edge. Four equally spaced apertures in the body below the disc are in flow communication with the body's bottom opening and, hence, the main discharge nozzle of the carburetor for evenly dispersing the fuel onto the bottom surface of the disc. A retaining cap is concentrically oriented on the body below the apertures for sealably seating the body upon the venturi. A threaded top opening in the body is adapted for receiving a set screw which permits movement of the screw by the apertures for constricting the apertures so that the atomizing device adjustably atomizes and disperses the fuel. Because of the air depression or vacuum in the vicinity of the venturi stack 14, the gasoline readily dispenses onto the bottom of the disc and is completely atomized as it is pulled off the outer diameter edge by action of the air flow downwardly through the carburetor which impinges upon the top surface of the disc creating a further vacuum under the atomizing disc.

32 Claims, 5 Drawing Sheets

FUEL ATOMIZING DEVICE FOR CARBURETORS

BACKGROUND OF THE INVENTION

This invention relates to a fuel atomizing device to be added on to a gasoline carburetor to improve the efficiency and performance of the carburetor and associated engine.

Referring to prior art FIGS. 1 and 2, the purpose a carburetor 10 on a gasoline engine is to meter, atomize and deliver the atomized gasoline fuel to the engine These functions are performed by the carburetor over a wide range of engine operating conditions. A thorough atomization of the gasoline fuel to be delivered into the engine will ensure peak performance and efficiency of the engine.

The carburetor 10 has a top air valve or butterfly 12 which permits air to be drawn into the engine through the carburetor by way of the partial vacuum which is created in the cylinders on the downward strokes of the pistons. As the air is drawn by the air valve 12, it must pass through the triple venturi stack 14 which is common to most carburetors 10. At the venturi stack 14 the air is mixed with gasoline and delivered to the engine through the throttle valve 30.

The venturi stack 14 is comprised of a top boost venturi 16, a bottom boost venturi 18 and a main venturi 20. As the air rushes in and through the venturi stack 14, it is constricted or necked down and the air speeds up thereby reducing the pressure or creating an air depression inside the venturi stack 14. This air depression or suction action is multiplied without sacrificing air flow by the boost venturies 16 and 18. The leading or upper edge of the venturies 16 and 18 are shaped similarly to an aircraft wing. Air increases speed as it rushes over this curved surface creating the most depression or vacuum at the highest point. It is this vacuum or depression at this point which causes lift or suction so that the fuel is pulled up and out of the carburetor's main well 28 and through the main discharge nozzle 22 which has a top opening 24 (for air) and a side opening 26 (for gas atomizing and dispersion). The gasoline fuel is then mixed and dispersed with the incoming air in the venturi 14 region of the carburetor 10.

The throttle valve 30, which is suitably of a butterfly construction, is located at the bottom of the carburetor 10 and permits the mixed air and gasoline to enter into the intake manifold and on into the cylinders of the engine.

There is a need for a device which will further increase the atomization of the gasoline fuel as it is mixed with incoming air through the carburetor. Such a device would increase efficiency and performance of the carburetor and the associated engine.

SUMMARY OF THE INVENTION

A fuel atomizing device for carburetors having a main discharge nozzle located within at least one venturi. The device comprises a hollow body extending downwardly and outwardly with a bottom opening adapted to slide over the main discharge nozzle in a sleeve-like arrangement. A fuel atomizing disc is supported concentrically by the body having top and bottom surfaces and an outer diameter atomizing edge. Four equally spaced apertures in the body below the disc are in flow communication with the body's bottom opening and, hence, the main discharge nozzle of the carburetor for evenly dispersing the fuel onto the bottom surface of the disc. A retaining cap is concentrically oriented on the body below the apertures for sealably seating the body upon the venturi. A threaded top opening in the body is adapted for receiving a set screw which permits movement of the screw by the apertures for constricting the apertures so that the atomizing device adjustably atomizes and disperses the fuel. Because of the air depression or vacuum in the vicinity of the venturi stack 14, the gasoline readily dispenses onto the bottom of the disc and is completely atomized as it is pulled off the outer diameter edge by action of the air flow downwardly through the carburetor which impinges upon the top surface of the disc creating a further vacuum under the atomizing disc.

A principal advantage of the present invention is that the performance and efficiency of the carburetor and engine is greatly enhanced manifest by increased mileage, horsepower and engine responsiveness while hydrocarbons or raw fuel out the exhaust of the engine is reduced.

The atomizing device is extremely simple to manufacture and only takes moments to install without removal of the carburetor from the engine. The device has no moving parts and hence has a long life and is inexpensive to manufacture.

DETAILED DESCRIPTION OF THE PREFERRED EMBODIMENT

Figure 1:
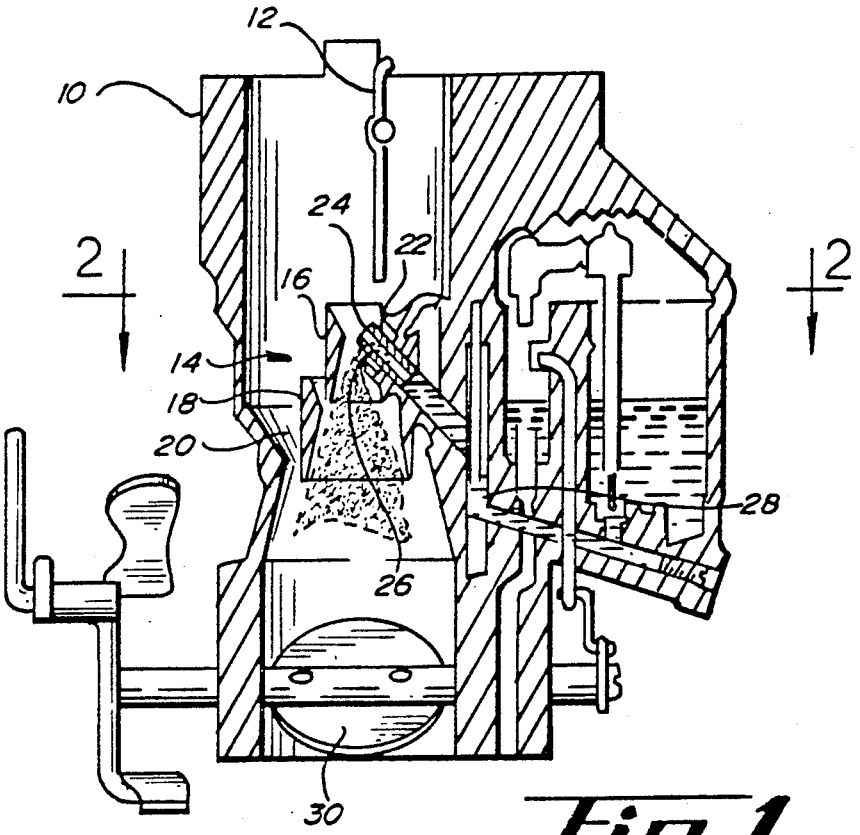
FIG. 1 is a prior art cross-sectional schematic view of a monojet carburetor.
Figure 2:
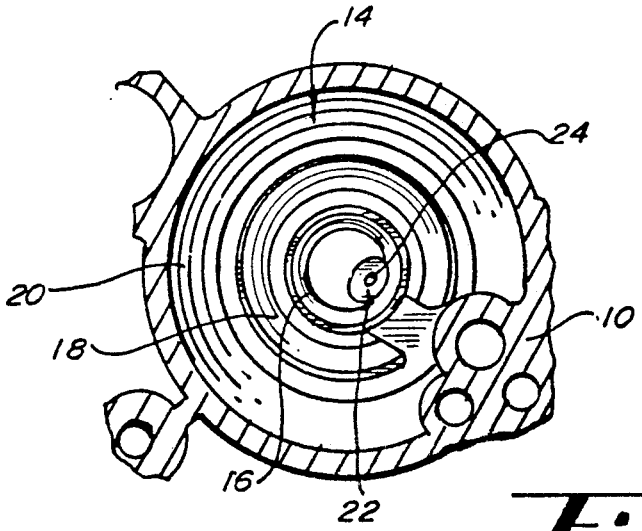
FIG. 2 is a cross-sectional view along lines 2—2 of FIG. 1 showing a venturi stack partially broken away.
Figure 3:
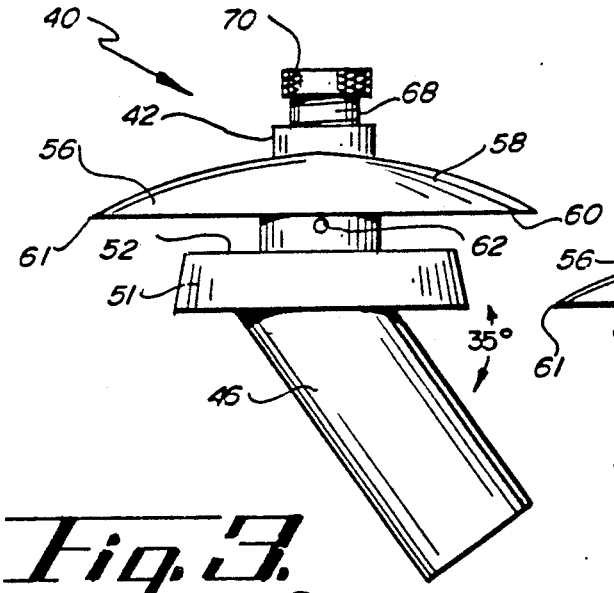
FIG. 3 is a side elevational view of the present invention.
Figure 4:
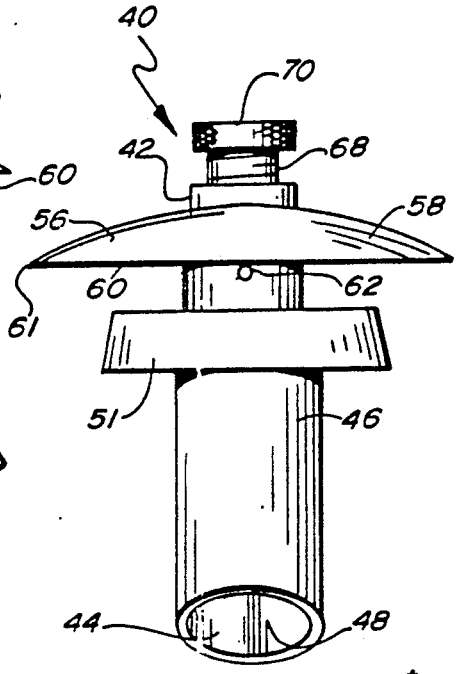
FIG. 4 is a rear elevational view of the invention.
Figure 5:
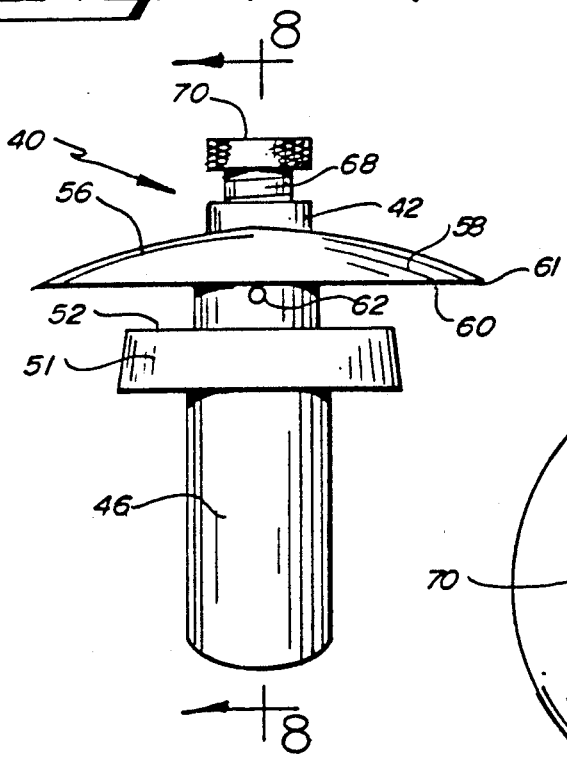
FIG. 5 is a front elevational view of the invention.
Figure 6:
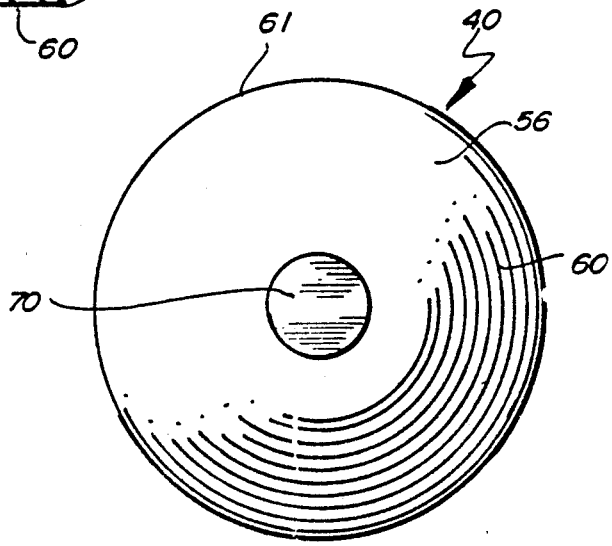
FIG. 6 is a top plan view of the invention.

Referring to FIGS. 3-9, the fuel atomizing device 40 may generally be seen. The device 40 generally includes a hollow body 42, a downwardly and outwardly projecting sleeve portion 46, a retaining cap 52, an atomizing disc 56, four radiating outwardly, equal distant apertures 62 in the body 42 and a set screw for constricting the flow communication through the apertures 62.

More particularly, hollow body 42 has a bottom surface 43 from which protrudes downwardly and outwardly the sleeve portion 46 which has a bottom opening 48. Hollow body 42 has conduit 44 extending therethrough and in communication with bottom opening 48. Sleeve portion 46 appropriately is approximately 35° from a horizontal plane.

Hollow body 42 has a first annular shoulder 50 which is centrally located on body 42 for concentrically supporting and affixing thereat a retaining cap 52 which has downwardly projecting lip 51.

Body 42 has a second annular shoulder 54 for supporting and seating atomizing disc 56 which is preferably flexible and may be made from an elastomeric compound. Atomizing disc 56 appropriately has a convex top surface 58 and a flat bottom surface or underside 60. Top and bottom surfaces 58 and 60 meet at the outer diameter atomizing edge 61.

Body 42 has four equally spaced apertures 62 radiating outwardly below the atomizing disc 56 and above the retaining cap 52. Apertures 62 are in flow communication with conduit 44.

Hollow body 42 has a top opening 64 which suitably has a threaded inside wall 66. Set screw 68 appropriately is threadable within inside wall 66 and has a head 70 for adjustment of set screw 68 within top opening 64. Set screw 68, by this arrangement, may adjustably obstruct or construct apertures 62 to control the flow of fuel from bottom opening 48, through conduit 44 and out apertures 62.

The construction of the venturi stack 14 and main discharge nozzle 22 of known carburetors 10 are generally consistent in both dimensions and arrangements. Consequently, the following dimensions of the fuel atomizing device 40 have been found to work optimally with known carburetors 10 and are offered for purposes of illustration only.

The sleeve portion 46 suitably has an outer diameter of 0.250 inches with an inner diameter of 0.191 inches which readily permits the sleeve portion 46 to slide over the main discharge nozzle 22. Sleeve portion 46 is appropriately 35° from the horizontal to assure that the hollow body 42 and retaining cap 52 readily fits and seats upon top boost venturi 16 as sleeve portion 46 is fitted over nozzle 22.

Retaining cap 52 suitably has an outer diameter of 0.556 inches with a lip 51 extending downwardly approximately 0.127 inches. By this arrangement, retaining cap will securely sit upon top boost venturi 16 while lip 5I assures that no gas leaks out of the top of the boost venturi 16 but must exit through apertures 62.

Atomizing disc 56 appropriately has an outer diameter of 0.875 inches. A smaller diameter disc has been found to not adequately atomize the gasoline as demanded by most engines Increasing the diameter of disc 56 has been found to have a choking or flooding action causing the engine to gallop or operate unevenly The disc 56 suitably has a central thickness of .0.125 inches with a concave top surface 58 and flat bottom surface 60. The disc is suitably flexible and made of an elastomeric compound which will permit it to flex downwardly under the air flow vacuum action of the venturi stack 14 readily permitting the gas, which has a low viscosity, to readily atomize and be dispersed from outer diameter atomizing edge 61.

Four apertures 62 have been found to work well within hollow body 42 and suitably should have a diameter of 0.030 inches. Set screw 68 appropriately may be approximately ¼ inch in length and have a hand adjustable head 70 thereby permitting the set screw 68 to close down upon apertures 62 thereby adjusting the amount of gas to be dispersed upon the underside or bottom surface 60 of atomizing disc 56.

Figure 8:
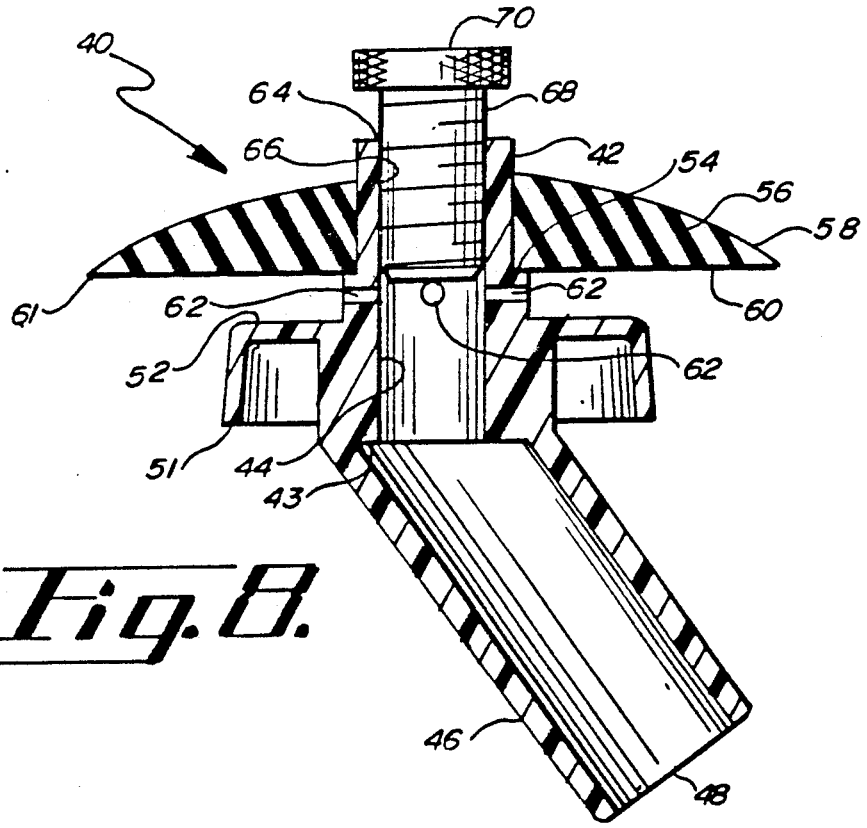
FIG. 8 is a cross-sectional view taken along lines 8—8 of FIG. 5 showing the fuel atomizing device of the present invention of a unitary or integral construction excepting the atomizing disc.
Figure 9:
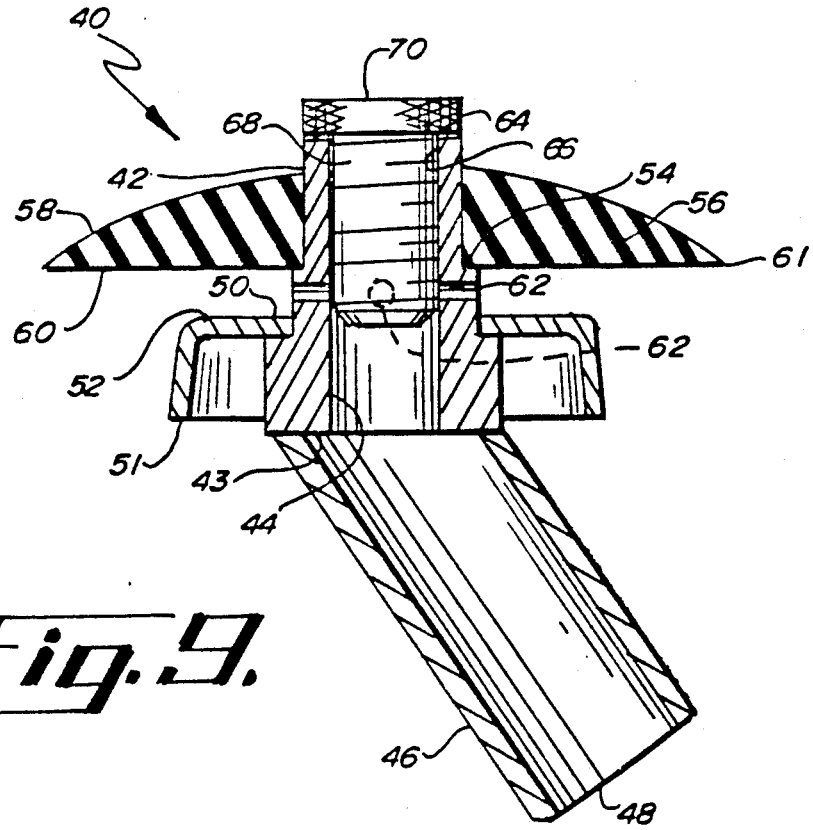
FIG. 9 is a similar view of FIG. 8 with the set screw adjusted downwardly closing the apertures and the device being made of assembled parts.

Fuel atomizing device 40, with the exception of atomizing disc 56, may be of a integral or unitary construction as shown in FIG. 8 and may be made of plastic suitably molded as is known. Atomizing device 40 may also be constructed of three components suitably affixed together and including the hollow body 42, retaining cap 52 and sleeve portion 46 as shown in FIG. 9.

Figure 10:
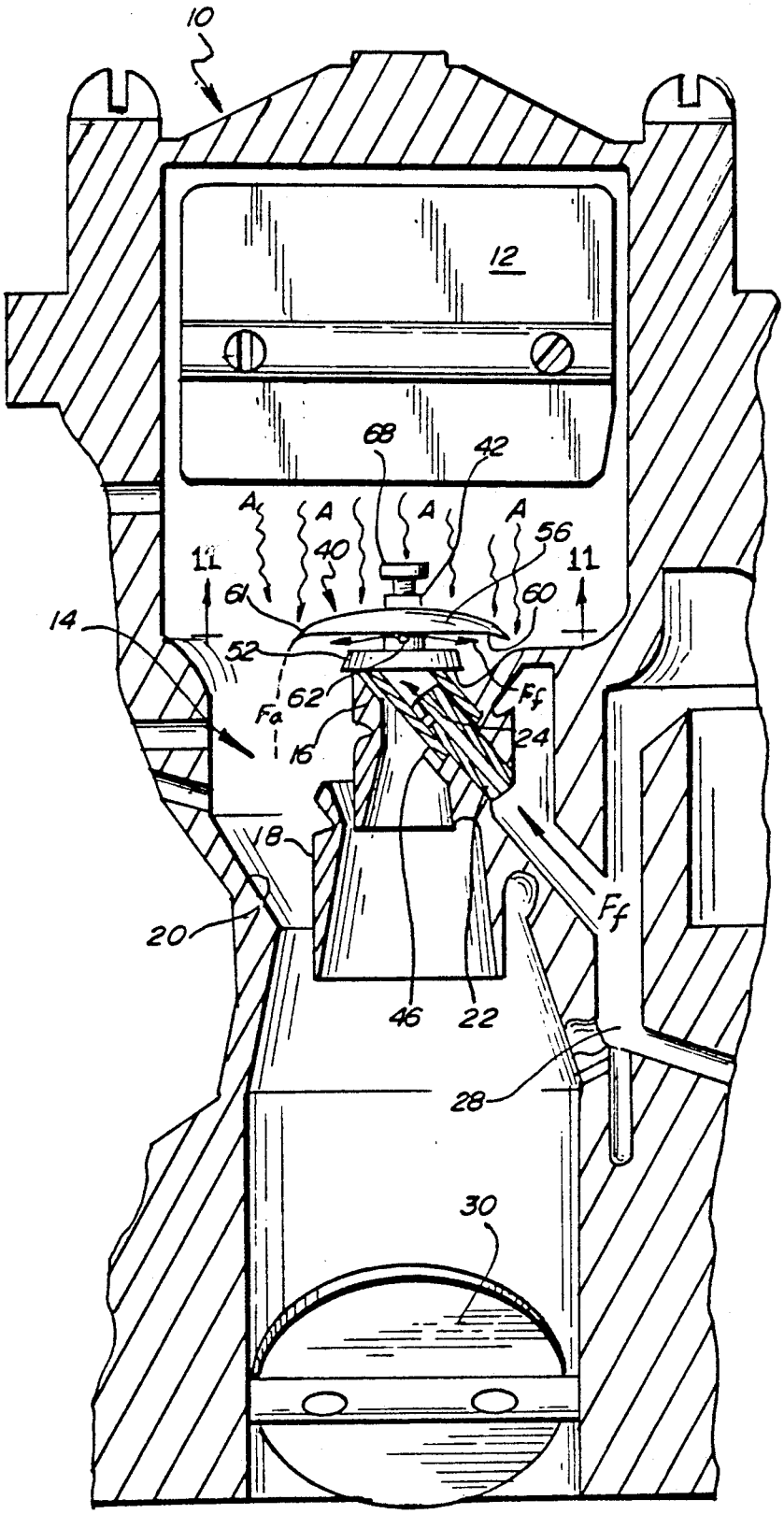
FIG. 10 is a cross-sectional view of a carburetor with the present invention installed and in operation with its sleeve portion partially cut away.
Figure 11:
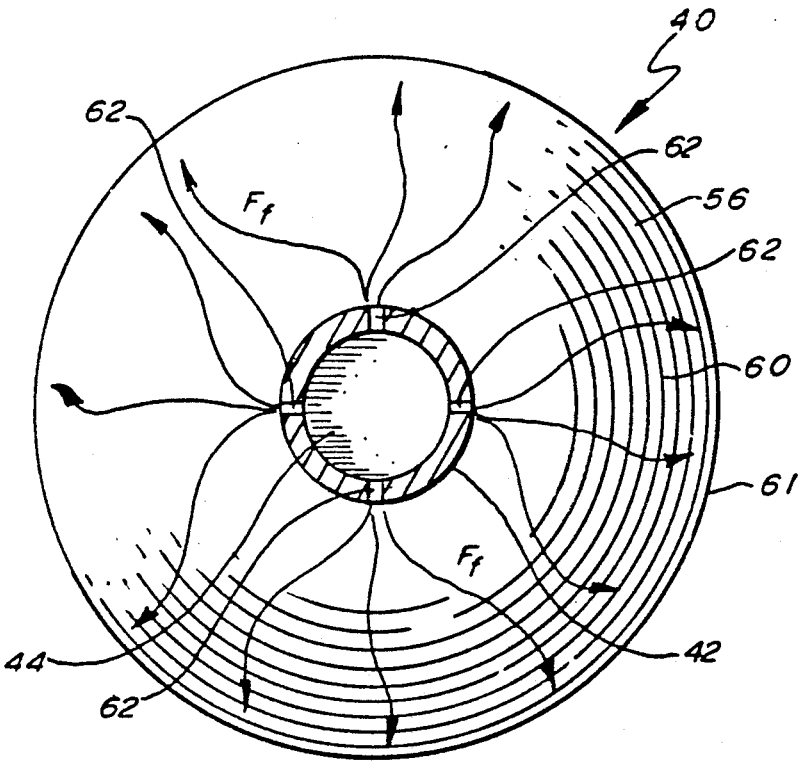
FIG. 11 is a cross-sectional view taken along line 11—11 of FIG. 10.
Figure 7:
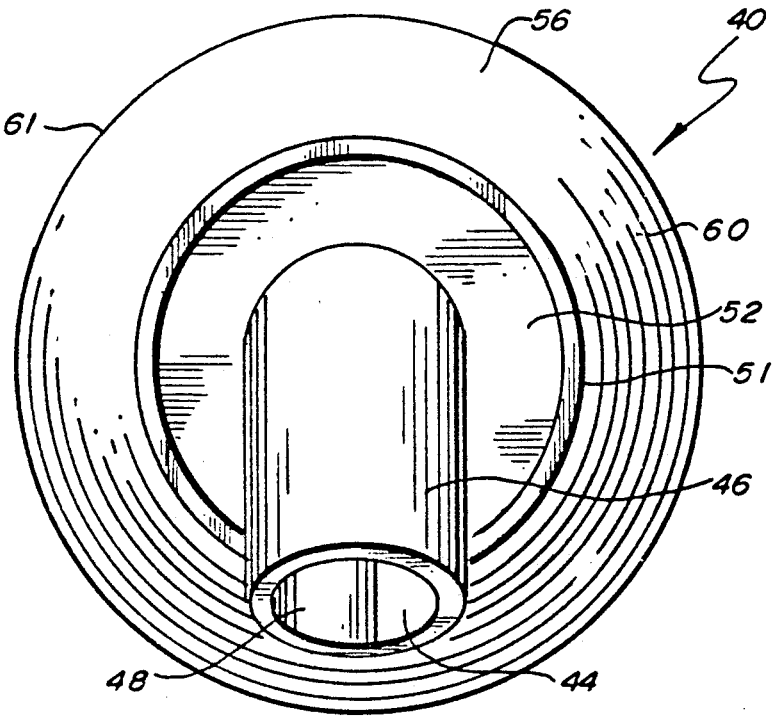
FIG. 7 is a bottom view of the invention.

Referring to FIGS. 10 and 11, the simple installation and operation of the fuel atomizing device 40 may be seen. Initially, the fuel atomizing device 40 is grasped by the head 70 of screw 68 and the sleeve portion 46 of hollow body 42 is guided downwardly and over the main discharge nozzle 22 within the top boost venturi 16 of the triple venturi stack 14.

When the engine is operated, the piston and cylinders create a vacuum which draws air (arrow A) through the air valve 12 of carburetor 10 and by and through the triple venturi stack 14. The venturi arrangement creates a vacuum or air depression centrally with respect to the venturi stack 14 with the greatest depression generally located adjacent the main discharge nozzle 22. The gasoline or fuel in fluid form is drawn (arrow $F_f$) from the main well by the vacuum or air depression, into nozzle 22, up through sleeve portion 46, into hollow body 42 and out apertures 62. Because gasoline has an extremely low viscosity and good dispersion qualities, the fuel readily disperses ($F_f$) out the four apertures and onto the flat bottom surface 60 of the atomizing disc 56 in an even manner (see FIG. 11).

As the incoming air (arrow A) impinges downwardly upon the convex top surface 58 of atomizing disc 56, the elastomeric atomizing disc 56 is somewhat flexed downwardly along its outer diameter atomizing edge 61. Also a further vacuum is created under the atomizing disc 56 along the bottom surface 60 adjacent the atomizing edge 61 to draw the liquid fuel or gas (arrow $F_f$) outwardly to the atomizing edge 61. At edge 61, the localized vacuum and associated air turbulence literally rips and atomizes the liquid fuel or gas off the outer diameter atomizing edge 61 ($F_a$) The atomized fuel is next carried through the carburetor beyond the throttle valve 30 into the engine.

Depending upon the particular carburetor and engine the set screw 68 may be adjusted by means of turning the head 70 to adjust the constriction or destruction of apertures 62 until the engine operates efficiently and with good performance throughout various operating conditions.

The present invention may be embodied in other specific forms without departing from the spirit or essential attributes thereof; and it is therefore desired that the present embodiment be considered in all respects as illustrative and not restrictive, reference being made to the appended claims rather than to the foregoing description to indicate the scope of the invention.

WHAT IS CLAIMED:

1. A fuel atomizing device for carburetors which have a main discharge nozzle located within at least one venturi, comprising;

(a) a hollow body extending downwardly with a bottom opening adapted to slide over the main discharge nozzle in a sleeve-like arrangement and the body being adapted to sealably seat on top of the venturi;

(b) a fuel atomizing disc supported by the body concentrically above the venturi having top and bottom surfaces and an outer diameter atomizing edge;

(c) at least one aperture in the body below the disc in flow communication with the main discharge nozzle through the bottom opening for evenly dispersing fuel to the bottom surface of the disc which is atomized as it is pulled from the outer diameter edge by the action of air flow through the carburetor and upon the top surface of the disc.

2. The atomizing device of claim 1, wherein the atomizing disc is elastomeric.

3. The atomizing device of claim 1, wherein the atomizing disc has a convex top surface.

4. The atomizing device of claim 1, wherein the body has four equally spaced apertures into the body below the disc in flow communication with the main discharge nozzle.

5. The atomizing device of claim 4, wherein the apertures are approximately 0.030 of an inch in diameter.

6. The atomizing device of claim 1, further comprising a set screw turnably mounted in the body and adapted to constrict the flow communication between the aperture and main discharge nozzle.

7. The atomizing device of claim 1, further comprising a retaining cap concentrically oriented on the body below the aperture for sealably seating the body upon the venturi.

8. The atomizing device of claim 7, wherein the body and the cap are integral.

9. The atomizing device of claim 6, further comprising a threaded top opening in the body adaptable for receiving the set screw to move the screw by the aperture for constricting the aperture so that the atomizing device adjustably dispenses and atomizes fuel.

10. The atomizing device of claim 9, wherein the set screw is self-locking and hand adjustable.

11. The atomizing device of claim 1, wherein the hollow body includes a sleeve portion extending downwardly and outwardly at approximately 35 from horizontal having the bottom opening therein for sliding over the main discharge nozzle.

12. The atomizing device of claim 1, wherein the atomizing disc is flexible.

13. A fuel atomizing device for carburetors which have a main discharge nozzle located within at least one venturi, comprising (a) an integral hollow body having a centrally and concentrically located retaining cap for sealably seating the body upon the venturi, a downwardly and outwardly extending sleeve adapted to slide over the main discharge nozzle upon seating of the body and at least one aperture in the body above the cap radiating outwardly and in flow communication with the nozzle through the sleeve; and (b) a fuel atomizing disc seated concentrically upon tne body above and closely to the aperture.

14. The atomizing device of claim 13, wherein the atomizing disc is elastomeric.

15. The atomizing device of claim 13, wherein the atomizing disc has a convex top surface.

16. The atomizing device of claim 13, wherein the body has four equally spaced apertures into the body below the disc and above the retaining cap in flow communication with the main discharge nozzle when seated on the venturi.

17. The atomizing device of claim 16, wherein the apertures are approximately 0.030 of an inch in diameter.

18. The atomizing device of claim 13, further comprising a set screw turnably mounted in the body and adapted to constrict the flow communication between the aperture and main discharge nozzle.

19. The atomizing device of claim 1-8, further comprising a threaded top opening in the body adaptable for receiving the set screw to move the screw by the aperture for constricting the aperture so that the atomizing device adjustably dispenses and atomizes fuel.

20. The atomizing device of claim 19, wherein the set screw is self-locking and hand adjustable.

21. The atomizing device of claim 13, wherein the hollow body sleeve portion extends downwardly and outwardly at approximately 35° from horizontal for sliding over the main discharge nozzle.

22. A fuel atomizing device for carburetors which have a main discharge nozzle located within at least one venturi, comprising;

(a) a hollow body extending downwardly with a bottom opening adapted to slide over the main discharge nozzle in a sleeve-like arrangement;

(b) a fuel atomizing disc supported by the body concentrically above the venturi when the body is slid over the nozzle having top and bottom surfaces and an outer diameter atomizing edge;

(c) four equally spaced apertures in the body radiating outwardly, below the disc and in flow communication with the main discharge nozzle through the bottom opening for evenly dispersing fuel to the bottom surface of the disc which is atomized as it is ripped from the outer diameter edge by the action of air flow through the carburetor and upon the top surface of the disc;

(d) a retaining cap concentrically oriented on the body below the apertures for sealably seating the body upon the venturi; and (e) A threaded top opening in the body adaptable for receiving the set screw and adapted to move the screw by the apertures for constricting the apertures so that the atomizing device adjustably atomizes and dispenses fuel.

23. A fuel atomizing device for carburetors which have a fuel discharge located within a venturi stack with at least one boost venturi, comprising: a fuel atomizing disc seated and concentrically secured on top of the boost venturi having top and bottom surfaces and an outer diameter atomizing edge, whereby the disc draws fuel from the discharge onto the bottom surface which is atomized as it is pulled from the outer diameter edge by action of the air flow through the carburetor and upon the top surface of the disc and by the atomizing edge.

24. The fuel atomizing device of claim 23, wherein the atomizing disc is elastomeric.

25. The fuel atomizing device of claim 23, wherein the atomizing disc has a convex top surface.

26. The fuel atomizing device of claim 23, wherein the atomizing disc is flexible.

27. The fuel atomizing device of claim 23, wherein the atomizing disc has a flat bottom surface.

28. The fuel atomizing device of claim 23, wherein the atomizing disc is flexible.

29. The fuel atomizing device of claim 23, wherein the atomizing disc is horizontally seated on the venturi stack.

30. The fuel atomizing device of claim 23, wherein the atomizing disc is seated perpendicularly with respect to the stack.

31. The fuel atomizing device of claim 23, wherein the atomizing disc has a diameter greater than the boost venturi.

32. A fuel atomizing device for carburetors which have a fuel discharge located within a venturi sack with at least one boost venturi, comprising: a fuel atomizing disc having a diameter greater than the boost venturi, a flat bottom surface, a convex top surface and an outer diameter atomizing edge, the disc being supported and securely seated concentrically on top of the boost venturi, whereby it draws fuel from the discharge onto the bottom surface which is atomized as it is pulled from the outer diameter edge by action of the air flow through the carburetor and upon the top surface of the disc and by the atomizing edge.

* * * * *